United States Patent [19]

Kraiss

[11] Patent Number: 5,040,968

[45] Date of Patent: Aug. 20, 1991

[54] DEVICE FOR MANUFACTURING CONCRETE PARTS

[75] Inventor: Richard Kraiss, Laichingen-Suppingen, Fed. Rep. of Germany

[73] Assignee: Georg Prinzing GmbH & Co. KG, Blaubeurer, Fed. Rep. of Germany

[21] Appl. No.: 315,460

[22] Filed: Feb. 24, 1989

[30] Foreign Application Priority Data

Feb. 24, 1988 [DE] Fed. Rep. of Germany ..... 3805720
Dec. 29, 1988 [EP] European Pat. Off. ..... 88121815.0

[51] Int. Cl.[5] ..... B28B 21/26; B28B 21/28

[52] U.S. Cl. ..... 425/426; 264/72; 264/312; 264/333; 425/262; 425/427; 425/429; 425/432; 425/454

[58] Field of Search ..... 425/262, 426, 427, 429, 425/432, 454; 264/72, 312, 333

[56] References Cited

U.S. PATENT DOCUMENTS

| | | | |
|---|---|---|---|
| Re. 28,902 | 7/1976 | Trautner et al. | 425/262 |
| 1,895,740 | 1/1933 | Ukropina | 425/262 |
| 3,083,433 | 4/1963 | Tiller | 425/262 |
| 3,096,556 | 7/1963 | Woods | 425/262 |
| 3,383,742 | 5/1968 | Nelson | 425/426 |
| 3,746,494 | 7/1973 | Gauger | 425/262 |
| 4,253,814 | 3/1981 | Christian | 425/427 |
| 4,540,539 | 9/1985 | Crawford et al. | 425/427 |
| 4,639,342 | 1/1987 | Adly | 425/262 |

FOREIGN PATENT DOCUMENTS

| | | | |
|---|---|---|---|
| 107014 | 4/1967 | Denmark | 425/262 |
| 1143750 | 2/1963 | Fed. Rep. of Germany | 425/427 |
| 2739000 | 3/1979 | Fed. Rep. of Germany | 425/427 |
| 1004114 | 3/1983 | U.S.S.R. | 425/427 |
| 610040 | 10/1948 | United Kingdom | 425/426 |

*Primary Examiner*—Jay H. Woo
*Assistant Examiner*—James P. Mackey
*Attorney, Agent, or Firm*—Michael J. Striker

[57] ABSTRACT

A device for manufacturing concrete parts, particularly concrete pipes, and based on the principle of sinking mold whereby a molding bottom ring together with a jacket are continuously lowered relative to a stationary mold core while concrete mixture is poured from above and distributed into the emerging molding space by a radial pressing device mounted on the top end of the mold core. Simultaneously with the lowering of the mold jacket and the molding bottom ring a supply device for delivering the concrete material is also lowered such as to keep a constant distance from the open top end of the mold jacekt. The radial pressing device is designed to compact the incoming concrete material in radial direction without imparting any torque thereto. In this manner any stress in the finished part, particularly between the concrete and reinforcing wire mesh is effectively avoided.

27 Claims, 9 Drawing Sheets

DEVICE FOR MANUFACTURING CONCRETE PARTS

BACKGROUND OF THE INVENTION

The present invention relates to a device for manufacturing concrete parts, particularly tubular parts in a sinking mold of the type which includes an upright holding fixture, preferably in the form of a central vibrator, secured to a stationary support, a mold core releasably mounted on the holding fixture, a mold jacket, a molding bottom ring and means for supplying concrete material.

In a known manufacturing device of this kind operating with sinking mold jacket or rising mold core it is possible to produce concrete pipes, and also steel concrete pipes provided with a reinforcing wire mesh. If the device is operated according to the method of a rising mold core, very deep underfloor pits are necessary. If instead it is operated according to the known method of a sinking mold jacket, then the concrete material is supplied from a stationary supply device situated above the mold and concrete material is dropped from above into an open molding space. Due to the fact that in the device using the sinking mold method the mold jacket is continuously lowered relative to the mold core, the distance between the top end of the mold jacket and the supply device keeps increasing and accordingly there is a growing risk that the falling concrete material splinters to all sides and thus pollutes the parts of the molding machine and impairs the operation.

When the filling of the molding space is completed then the excessive concrete material must have been removed by hand because there has been no possibility to remove it and also to smoothen the upper end of the concrete part by the machine. In the processing of tubular parts by means of a radial pressing device the upper end of the concrete pipe has been shaped by a radial pressing and compacting action which has been found as inadequate. In summary, the following difficulties have been encountered: If it is desired to produce steel concrete pipes there occurs for example the problem that during the filling process the introduced concrete material is catched in the reinforcing wire mesh and immediately compacted whereby cavities can result within the concrete part and a uniform filling and compacting of the concrete material is not guaranteed. When the mold is completely filled up and an additional comptacting is caried out by vibrations then stresses in the reinforcing wire mesh can be caused because the concrete material pulls the wire mesh downwards. Such stresses may lead to the formation of cracks during the subsequent removal of the mold jacket. Moreover, it may happen that the wires at the low side of the reinforcing mesh do not contact the concrete material but form therewith a cavity. Another substantial disadvantage is in that due to circular vibrations of the central vibrator a turning of the reinforcing wire mesh may occur such that further strain develops between the reinforcement and the concrete material in the completed tubular concrete part. This strain may lead to crack formations during the subsequent mold shell removal and in addition, to bending of the concrete parts, for example pipes. When using hydraulic compression with simultaneous vibration of the upper molding ring, the introduced pressing forces can also strain the reinforcing wire mesh which upon the removal of the molding shell are released and again may cause great damage in the finished concrete part.

SUMMARY OF THE INVENTION

It is therefore a general object of the present invention to overcome the aforementioned disadvantages.

More particularly, it is an object of the invention to provide an improved device for manufacturing concrete parts wherein the danger of the crack formation in the completed parts especially during and after the removal of the mold jacket are at least substantially eliminated.

In keeping with these objects and others which will become apparent hereafter, one feature of this invention resides in the steps of placing the molding bottom ring in a first level above the mold core, depositing the mold jacket on the molding bottom ring, sinking the mold jacket together with the molding bottom ring to a second level at which the mold core enters the mold bottom ring, supplying the concrete material at a third level above the mold jacket and discharging the concrete material at a discharge point above the open top end of the mold jacket, continuing the sinking of the mold jacket together with the mold bottom ring while distributing the concrete material to the molding interspace emerging between the mold core and the mold jacket, and at the same time, lowering the level of supplying of the concrete material to keep a substantially constant distance between the discharge point and the open top end of the mold jacket.

Since during the filling and compacting process the entire concrete material supply device follows the downward movement of the mold jacket, the supply device and thus the discharge point of the concrete material remain always at the same relative position closely above the open upper end of the mold jacket. In this manner the danger that during the charging some concrete material is splattered in the range outside the mold jacket and thus is missing in the molding interspace, is counteracted and the inadequate filling of the molding space and the resulting disadvantages are substantially eliminated. The risk of the inadequate filling and compacting of the concrete material in the mold is eliminated also in the case when concrete parts reinforced by a steel wire mesh are being manufactured. At the same time it is achieved that the charged concrete material in the area of filling is more uniformly distributed and compacted and therefore a more homogenous filling of the molding interspace is obtained. A further advantage is in the fact that any fouling of the molding machine and of the adjacent environment due to the splattered concrete material is substantially eliminated and as a result a disturbance free operation is guaranteed. By virtue of a short path of fall of the concrete material a correspondingly shorter pouring time results. This has the advantage of shorter processing times in machine operations and in simpler as well as more accurate control.

In the device of this invention almost no forces in circumferential direction are applied on the charged in concrete material. By lowering a top molding ring and pressing the same against concrete material in the molding interspace, the desired length of the concrete part is determined in a reproducible manner, and precisely shaped ends, especially the top ends of the concrete parts are obtained whereby a homogenous texture is achievable because the shaping is carried out by the axial compression and not by the conventional radial compacting from the inside toward the outside. Another advantage results from the fact that by means of the top molding ring the completed concrete part remains under load even after the removal of the mold jacket and the top molding ring acts as a press pad so that a reliable, disturbance-free process for removing the mold jacket is made possible and the risk is precluded that the completed concrete part, such as for example a completed tube does not crack or is not damaged by the formation of cracks in the range of shaped ends, for example of the top ends. The method of this invention creates a among others the condition for designing manufacturing devices which are extraordinarily verstile and suitable for the production in an automatic process almost of all products needed for the construction at underground level. This applies mostly for the non-reinforced concrete parts such as for example concrete pipes and for steel concrete parts for example steel reinforced concrete pipes and the like. The invention enables the production in an assembled mold for example, of shafts, cones, pipes and the like concrete parts, also with embedded components such as for example climbing irons, inner lining and the like.

The device of this invention is characterized by upright guiding means secured to the stationary support to guide the concrete supplying means in opposite, substantially vertical directions relative to the top end of the sinking mold jacket. The device is applicable for the manufacturing of practically all concrete products needed in the underground construction. For example the device of this invention can produce in an automatic process shaft rings, shaft legs, small pipes for example up to 1,000 mm of total height, pipes up to 2,500 mm of total height, street drain pipes, rectangular tubular elements and the like whereby reinforcing wire meshes to produce steel concrete pipes are readily applicable. The device enables a uniform filling of the molding space with concrete material thus providing a uniform texture of the final product whereby in the steel concrete parts any cavities between concrete and reinforcing wire mesh are avoided. As mentioned before, any tension or stresses between the reinforcing wire mesh and the concrete are also eliminated. In summary, the danger of crack formation during the mold jacket removal is prevented.

The device of this invention includes also a radial pressing device by means of which the filled in concrete material is compacted in radial direction toward the mold jacket. For a mold having a jacket only without mold core a pressing device is known having a bottom cylindrical smoothing piston provided on its periphery with rollers rotatable about vertical axes and being arranged at equal angular distances one from another. The rollers function as pressing rollers. Originally the entire roller assembly was driven by a single shaft. However, this arrangement has the disadvantage that strong torque was exerted on the concrete material and particularly when manufacturing steel concrete parts, on the inserted reinforcing wire mesh. For this reason, the roller assembly or head was modified into a counter-rotational roller head in which the rotary movement of the soothing piston was opposite to that of the remaining rotary parts. This measure had reduced to a certain degree the effect of the torque. Nevertheless a rotation of the inserted reinforcing wire mesh could be completely eliminated. Another disadvantage is also the high degree of wear of the pressing rollers, the need of frequent cleaning of the latter and susceptibility to interference due to the concrete which may have deposited between individual rollers. It is also difficult to seal the bearings of the rollers. Due to high wear and high friction the entire roller head necessitates a very large driving power input and therefore costly driving motors with high power consumption are needed. Consequently the prior art pressing device is heavy and costly to manufacture. Moreover the control for the parts of the roller head rotating in opposite directions is complicated.

All these disadvantages are avoided by the provision of a pressing device arranged for movement in a radial plane transverse to the longitudinal axis of the mold and driven by a separate motor to exert pressure on concrete material in the molding interspace. The pressing head of this invention is preferably exchangeably mounted on the top end face of the mold core. Alternatively it can replace the prior art roller head on the soothing piston. It will be understood that in the following description the term "mold core" may also denote the soothing piston in a modified version of the mold or a similar supporting part. The pressing device includes a circumferential pressing ring which is brought into a continuous radial pressing movement; the ring itself, however, is not directly rotated but is coupled to an eccentric shaft by a bearing which introduces a relative rotary movement between the eccenter and the ring. Only a concrete distributing member on the top side of the pressing device is jointly rotated by the driving motor to uniformly convey the incoming concrete material radially outwardly and uniformly distribute the same in such a manner that the radial pressing head continuously compacts the concrete material. In this manner no torque is introduced into the concrete material under process. Consequently, any stresses and particularly any relative rotations of the inserted reinforcing wire mesh are prevented. Without exception the radial pressing movement does not impart any rotary motion to the concrete material. In addition, the device of this invention is subject to a very small wear leading to a reduced driving power consumption and to reduced operational costs. The pressing head requires only a single central bearing resulting also in a further cost reduction. The bearing is installed in the interior of the pressing head and protected against fauling or damage from the outside. It will be understood that the pressing head of this invention is either a part of the mold core or alternatively can be designed as a separate unit exchangeably attached to a conventional mold core. Since the radial pressing force exerted by the pressing head of this invention is sufficient for the complete compression of the concrete material then in principle any additional vibrators for the mold that means also the central vibrator in the mold core can be dispensed with.

The central vibrator used in the preferred embodiment of this invention sets the mold core into vibrations at a relatively high frequency and with small amplitudes for example in the order of 1 to 4 mm. The pressing head in contrast oscillates at a relatively lower frequency, for example in the range between 100 to 800 oscillations per minute and at large amplitudes for example between 10 and 15 mm. By means of an elastic support, such as for example at least one rubber block provided between the mold core and the pressing head, the two different amplitude values are made possible and the mutual interaction between the two oscillating parts is kept low. With advantage, the direction of rotation of vibrations imparted to the mold core by the vibrator is opposite to the direction of rotation of the unbalanced arm of the pressing head whereby the possibility of imparting any torque to the concrete material is further reduced. Due to the low rotary speed of the drive for the unbalanced arm the same driving shaft can be employed also for the distributing device. In addition, the elastic support device between the pressing head and the mold core provides an excellent protective seal. In a modification of this invention, the housing of the pressing head is utilized as a distributing member, preferably by the provision of a stepped plate on the upper wall of the housing so that the wear on the distributing device is further reduced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
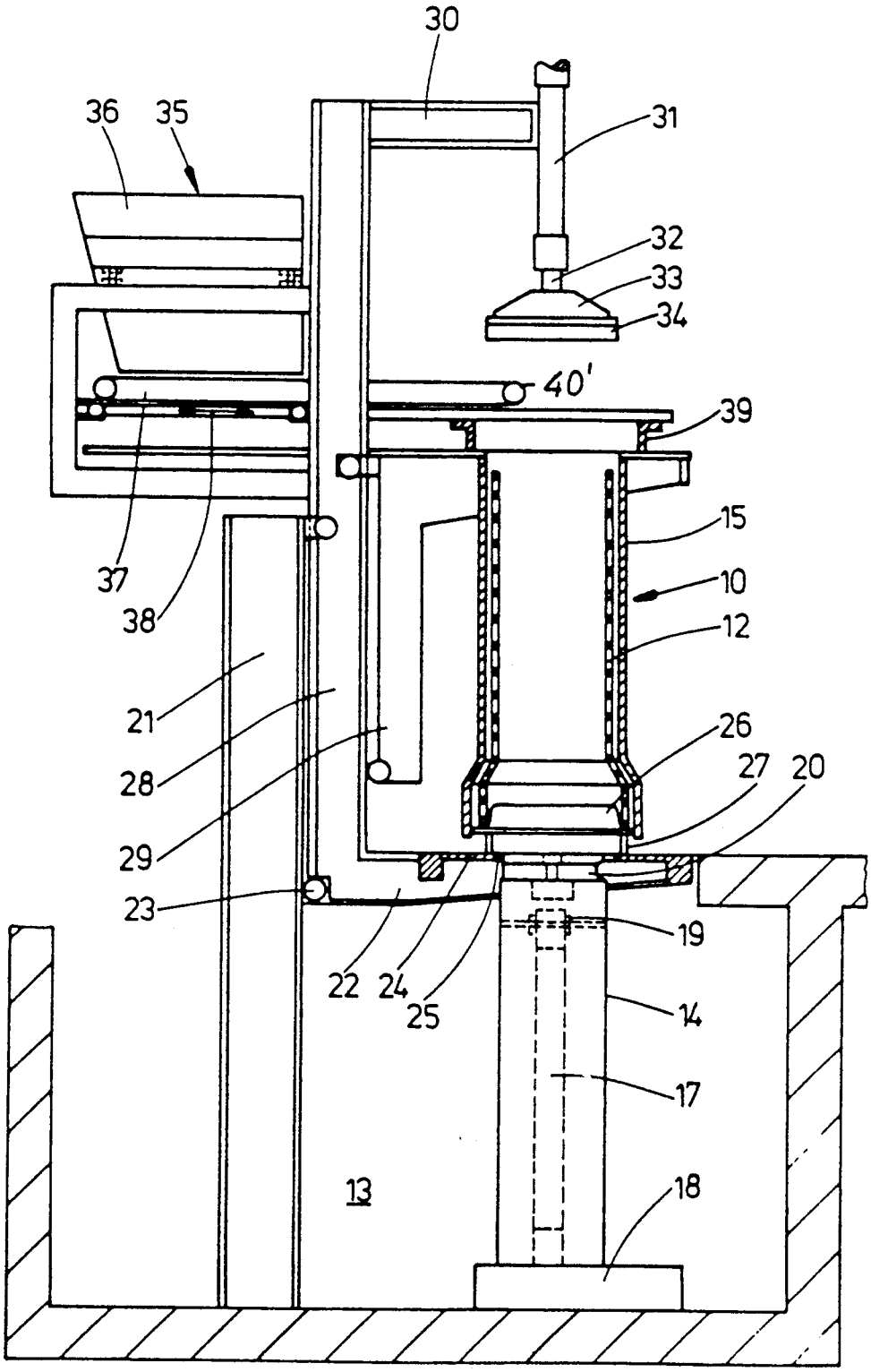
FIGS. 1 through 3 show schematically in a partly sectional side view a device for manufacturing concrete parts according to this invention each in a different working position.
Figure 2:
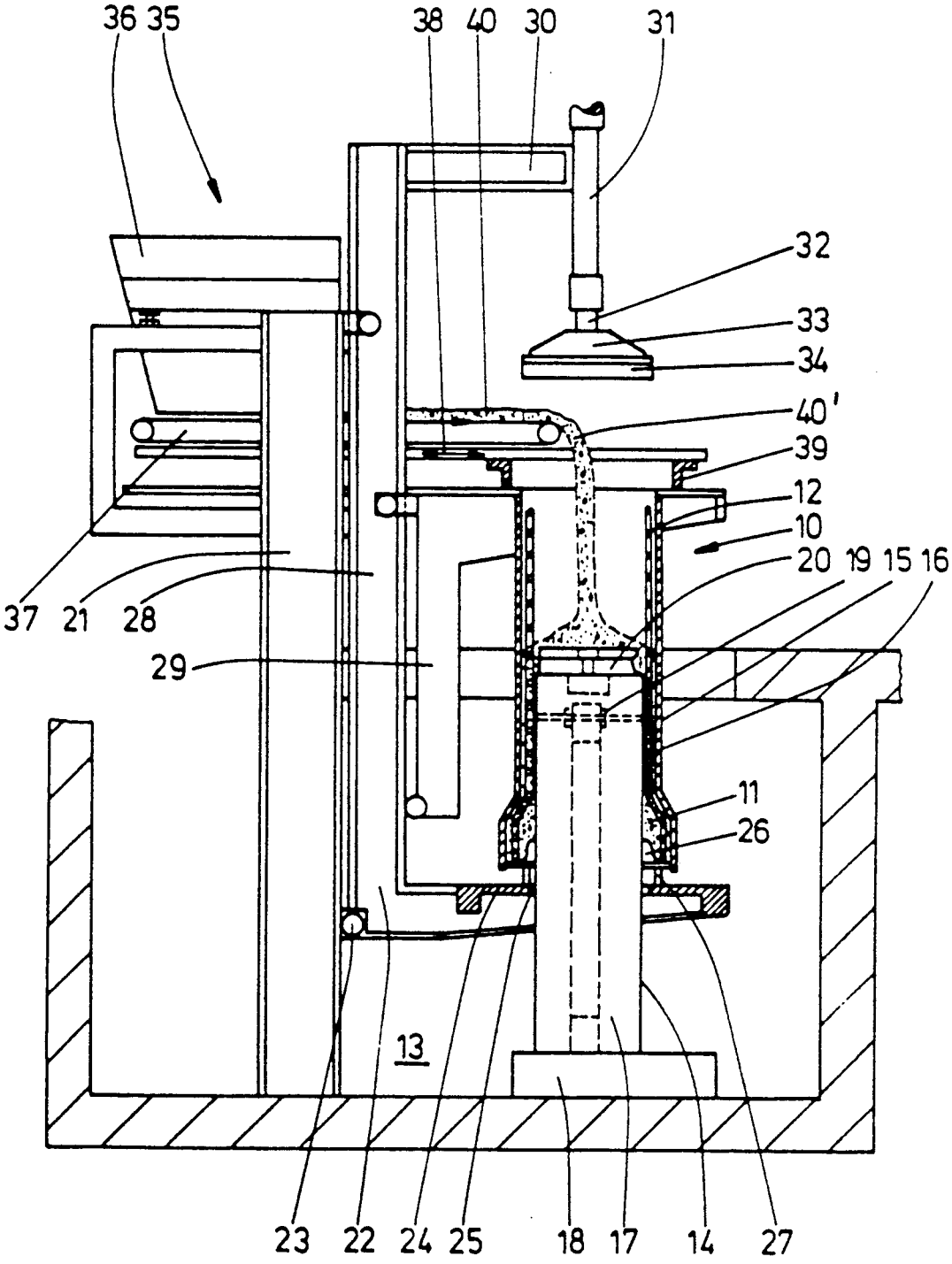
Figure 3:
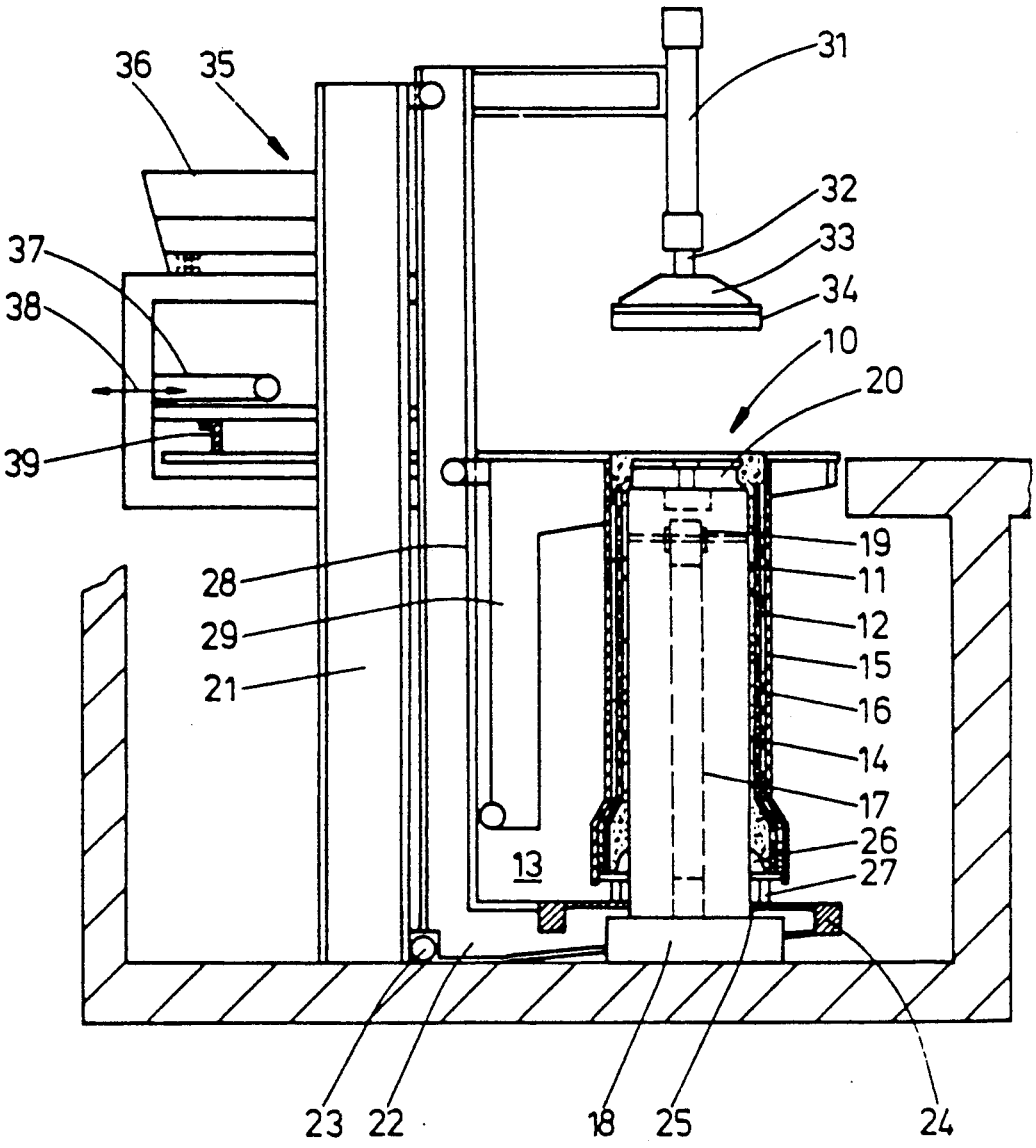

FIGS. 1 through 3 show schematically a device 10 designed for the production of concrete parts 11 according to this invention. In the illustrated example the concrete parts are steel concrete pipes provided with a reinforcing wire mesh 12. It will be understood that the device is suitable for the production of other kinds of concrete parts for example pipes without reinforcing wire mesh such as residential or street drain pipes, shaft rings, shaft butts and the like. In this embodiment the device 10 is constructed as an underfloor machine supported in an embedded pit 13. The concrete parts 11 are produced in a mold consisting of a mold core 14 and a mold jacket 15 which surrounds the mold core with a radial spacing to delimit a molding interspace 16. In this example, the mold core 14 is constructed as so-called vibrating core. It has the configuration of a cylindrical shell mounted on an upright central vibrator 17. The bottom side of the vibrator is secured to a base support 18 which is rigidly connected to the bottom of the pit 13. The upright vibrator 17 projects into the interior of the mold core 14 and extends up to the region of its upper end portion. In the top end region, the mold core 14 is releasably connected to the end of the vibrator 17 by means of a clamping device 19. The top end face of the mold core 14 is provided with a schematically indicated radial pressing device 20 which is an integral part of the mold core and its detailed construction will be explained later on.

The device of this invention includes a stationary upright guide 21 which is for example integrally connected to the machine frame at the bottom of the pit 13. The upright guide 21 supports and guides for a sliding movement in the vertical direction a schematically indicated mold ejector 22. The mold ejector has an L-shaped cross-section whose upright part forms a carriage 23 guided along the upright guide 21. The horizontal part of the mold ejector 22 carries a lower machine table 24 in the form of an exchangeable plate having a central opening 25 which slightly exceeds the outer diameter of the mold core 14 to pass the core therethrough. The lower machine table 24 serves as a seat for supporting the bottom mold ring or lower socket 26 which is a component part of the mold. The molding bottom ring 26 in this example rests on a vertical spacer 27 which engages the lower machine table 24. The molding bottom ring 26 serves for shaping the lower end portion of the concrete pipe 11 being produced. In this example, the lower end of the concrete part to be produced has a bell shaped configuration whereby the flared parts of the bell adjoining the lower end face of the concrete pipe is determined in conventional manner by the shape of the molding bottom ring 26.

The vertical part of the mold ejector 22 is provided with vertical guide track 28 for slidably supporting a guiding carriage 29. The horizontal part of carriage 29 holds the top end of the mold jacket 15 such that the latter is moved in vertical direction along the guide track 28.

The vertical guide track 28 of the mold ejector 22 projects relatively high above the upright guide 21 and is provided at its upper end with a horizontal arm 30 which supports a vertical translation drive 31, for example in the form of a cylinder and piston unit whose downwardly directed piston rod 32 is terminated with a disc 33. The disc 33 carries a molding top ring 34 which serves for shaping the upper end portion of the concrete part 11 being produced, for example the shaping of a spigot end of the pipe. By means of the translation drive 31 the molding top ring 34 is moved in vertical direction to and from the molding interspace 16. In addition, the translation drive 31 imparts to the top ring 34 a reciprocating rotary motion about its center axis.

The device 10 of this invention further includes at least one charging or supply device 35 for concrete material. As schematically illustrated the supply device 35 includes a storage container 36 for the concrete material and at least one conveying device 37, for example in the form of a horizontally directed conveyor band arranged below the storage container 36. The transporting or conveying device 37 extends in horizontal direction from storage container 36 toward a discharge point 40' above the open top of the mold jacket 15 in the carriage 29 and is arranged on a retractable support 38 which is movable by a non-illustrated drive in two opposite horizontal directions indicated by a double arrow. The free end portion of the retractable support 38 is connected with a downwardly directed wiping device 39, for example in the form of a wiper ring surrounding the discharge point 40' of the layer of concrete material 40 conveyed by the conveying device 37 and fed by a free fall into the mold jacket 15 (FIG. 2). The entire charging or supply device 35 is movable in vertical direction parallel to the center axis of the stationary mold core 14. Preferably the entire charging or supply device 35 is guided along a vertical track. In the illustrated example, the supply device 35 is firmly connected to the vertical part of the mold ejector 22 and is guided along the upright guide 21 which forms a part of the machine frame.

In another, non-illustrated embodiment there is provided a separate upright guide for the supply device 35 which is also an integral part of the machine frame and is provided with a separate vertically movable sliding carriage which supports the component parts of the supply device 35 and is driven by its own driving device for example by a pressure fluid actuated hydraulic drive.

The method of operation and of the production of concrete parts in the device 10 is as follows:

In a preliminary operational stage the carriage 29 with the suspended mold jacket 15 is lifted along the vertical guide track 28 from the position illustrated in FIG. 1 into its uppermost position close to the horizontal arm 30 in which the mold jacket 15 is completely withdrawn from the previously completed concrete part 11 and the part is removed. The carriage 29 with the mold jacket 15 then remains in the uppermost position. Thereafter a new molding bottom ring is provided with the reinforcing wire mesh 12 and deposited on the ejector plate of the lower machine table 24 either by hand or with advantage by means of an automatic device. In this example, it is assumed that only a single concrete part 11 is produced in an operational cycle. In principle, it is possible to produce a plurality of concrete parts having the same or different size in the same production cycle. In this case a corresponding number of molding bottom rings 26 are deposited side-by-side on the ejector plate of the lower table 24.

Then the drive of the carriage 29 is activated to move the mold jacket 15 downwardly along the guide track 18 until the lower end of the mold jacket engages the rim of the molding bottom ring 26 in the position illustrated in FIG. 1. During the downward movement of the mold jacket 15 the mold ejector 22 remains in its initial position illustrated in FIG. 1.

After the mold jacket has been seated on the molding bottom ring 26, the drive for the carriage 23 of the mold ejector 22 is actuated to move the carriage 23 and hence the mold ejector 22 downwards along the upright guide 21 until the top side of the mold core 14 together with radial pressing device 20 enter through the inner opening of the molding bottom ring 26 the lower part of the mold jacket 15. Then the supply device 35 for concrete material is activated to move the support 38 together with the conveying device 37 from its retracted position illustrated in FIG. 3 into its operative position illustrated in FIG. 1 in which the discharge point 40' of the conveying device is above the open top end of the mold jacket 15 and a layer 40 (FIG. 2) is transported by the conveying device 37 from the storage container 36 and discharged from above into the molding interspace 16. Simultaneously, the central vibrator 17 and the radial pressing device 20 are activated. As a consequence, the concrete material present on the top end of the mold core 14 is continuously displaced in radial direction into the molding interspace 16 and is compacted therein by combined actions of the vibrator 17 and radial pressing device 20. As mentioned before, the device 10 operates according to the so-called sinking mold method. That means that as soon as at the beginning of the operating cycle when the molding interspace 16 is filled with concrete material first in the region of the molding bottom ring 26 and the concrete is compacted into the lower bell-shaped interspace around the bottom ring 26, the entire mold ejector 22 together with the carriage 29 and the mold jacket 15 mounted thereon and further together with the supply device 35 for the concrete material are moved downwardly in vertical direction along the upright guide 21, preferably at a constant speed while continuously feeding by conveying device 37 a layer of concrete material 40 into the mold. By a non-illustrated dosing device the amount of concrete material 40 supplied by the supply device 35 is controlled in dependency on suitable operational parameters, such as for example, the power consumption or the torque of the radial pressing device 20. The torque can be determined for example from the input power required by driving aggregates or by pressure medium such as a pressure fluid in a hydraulic drive for the radial pressing device 20. According to the sensed power values the conveying device 37 is continuously controlled to convey a corresponding amount of concrete material 40. The charging proceeds in this manner while the mold ejector 22 together with the carriage 29, the mold jacket 15 and the supply device 35 keep sinking at a constant speed toward the bottom of the mold core 14. As soon as the top end of the mold core 14, namely the radial pressing device 20 mounted thereon, is approximately flush with the upper edge of the mold jacket 15 then the downward movement of the mold ejector 22 is stopped and the charging of the conveyor device 37 is interrupted. The support 38 together with the conveying device 37 is retracted to the left whereby the wiping device 39 attached to the bottom side of the free end of the support 38, wipes off excessive concrete material 40 at the upper end of the mold.

Subsequently, by means of the vertical translation drive 31 the molding top ring 34 is displaced from above into the top part of the molding interspace 16 until the top ring 34 reaches a predetermined level within the mold jacket 15. At this predetermined level the downward movement of the translation drive 31 is stopped and simultaneously a reciprocating or oscillatory rotary movement about the center axis of the mold is imparted to the top ring 34. Now the mold ejector 22 together with the carriage 29, the mold jacket 15 and the molding top ring 34 are slowly moved downwards whereby the top ring 34 is moved further into the molding interspace 16. During this downward movement of the top ring 34 the upper end of the concrete part 11 is shaped, for example to form the spigot end of the concrete tube. The length of the concrete tube is determined by the final position of the top ring 34 in the mold. The final position is constant in each working cycle because the top ring 34 does not exert any compacting pressure during its downward movement but merely provides a displacement of the concrete material. Only at the end of this process step the central vibrator 17 and the radial pressing device 20 are inactivated. To remove the mold jacket the carriage 29 together with the mold jacket 15 is moved upwards whereby the molding top ring 34 acts as a backing and remains in contact with the top end of the completed concrete part 11 to serve as a press pad. This arrangement enables a reliable shelling off process without the risk that the completed concrete part 11 such as a pipe, cracks or that the shaped end, for example the spigot end of the concrete part becomes damaged. Alternatively, it is also possible to move the mold ejector 22 upwards simultaneously with the mold jacket 15 whereby the top ring 24 again serves as a press pad. The device 10 enables a novel method of manufacturing concrete parts 11 such as pipes, shaft rings and the like which can be employed particularly when steel concrete pipes with embedded reinforcing wire mesh are to be manufactured, to operate according to the principle of the sinking mold. The method of this invention is characterized in that the mold ejector 22 and/or the reinforcing wire mesh 12 are first put on the molding bottom ring 26 situated above the mold core 14. Then the bottom ring 26 together with the reinforcing wire mesh 12 and the mold jacket 15 are moved down to such an extent until the upper end of mold core 14 and the radial pressing device 20 arranged on the top end enters the bottom ring 26 and the mold jacket 15. Thereafter a layer of concrete material 40 is fed into the molding interspace 16 from above while the vibrator 17 and the radial pressing device 20 are activated to distribute and compact the charged concrete material until the mold jacket and the bottom ring 26 are lowered to their final position at the bottom of the mold core 14. The charging or supply device 35 is lowered substantially in synchronism with the sinking of the bottom ring 26 and mold jacket 15 such that the discharge point 40 of the concrete material remains always at the same distance from the open end of the mold jacket 15. Due to this simultaneous downward movement of the supply device 35 and the mold jacket 15, the discharged layer of concrete material 40 thus falls into the mold substantially within the height range of the latter. As mentioned before, the supply device 35 can be moved together with the mold ejector 22 which also carries the mold jacket 15 and the bottom ring 26 or by a separate guided drive independently of the mold jacket. In both cases, the mold jacket 15 and the supply device 35 are lowered at the same constant speed. Then when the bottom ring 26 and the mold jacket 15 have reached the lower end position the conveying device 37 in the supply device 35 is retracted laterally away from the top end of the mold jacket 15 whereby the wiper device 39 on the support for the conveying device wipes off excessive concrete material at the top end of the mold. After this wiping step has been completed, the top ring 34 is moved from above into the open end of the molding interspace 16 to reach a predetermined level therein. At this level, the top ring 34 can be rotated back and forth about its center axis. Thereafter the bottom ring 26 together with the mold jacket 15 and the top ring 34 are simultaneously, that means as a single unit further lowered whereby the top ring 34 shapes the top end of the concrete part 11, for example to form a spigot end without exerting any compacting pressure with its disadvantageous consequences.

The device for the manufacturing of concrete parts according to this invention has the following advantages: The device 10 enables an automatic production almost of all concrete products needed for the construction below ground level, that means concrete parts of diversified types and sizes, such as shaft rings, shaft butts, small pipes up to 1,000 mm height, pipes up to 2,500 mm height, street draining pipes, rectangular pieces, steel concrete pipes and the like. Consequently, the device 10 is extremely versatile. It permits a substantially improved utilization by its user. Furthermore, it is also of advantage that in the manufacture of pipes especially of those provided with the reinforcing wire mesh 12, any stresses which hitherto resulted between the wire mesh and the concrete material are eliminated. In conventional devices of this kind there has been the problem that in the course of the filling process the concrete material was catched on the reinforcing wire mesh and the remaining part was immediately compacted so that cavities resulted within the concrete part, particularly within a steel concrete pipe, because a uniform filling and compacting could not be guaranteed. Furthermore, when the mold was filled up and a further compacting was followed by vibrations, there resulted stresses in the reinforcing wire mesh because the concrete tends to draw the wire mesh downwards. Such stresses during the subsequent removal of the mold jacket may lead to the formation of cracks in the completed concrete part 11. Moreover, it happens that the wires of the reinforcing mesh are surrounded by cavities at their lower sides. Furthermore, the known devices have the serious drawback that due to circular motions or rotary vibrations of the vibrator an angular displacement or turning of the reinforcing wire mesh occurred so that between the wire mesh and the charged concrete material additional stresses developed. In the subsequent removal of the mold jacket the additional stresses again may cause cracks and/or an arching of the finished concrete part, for example a pipe. In addition, compacting pressures introduced in conventional devices by molding upper or top ring in combination with the superposed vibrations have produced additional stresses in the reinforcing wire mesh which again after the removal of the shell lead to the crack formation.

The device 10 of this invention makes it possible to completely eliminate any stresses between the reinforcing wire mesh 12 and the remainder of the finished concrete part 11, thus avoiding the formation of cracks during the withdrawal of the mold. Any angular displacements of the reinforcing wire mesh about the longitudinal axis of the mold are counteracted. Since the feeding of the concrete material from the supply device 35 takes place always from a constant height with respect to the mold jacket 15, namely closely to its top end, any splattering or spraying of the concrete material during its filling is avoided. The charging of the mold proceeds more uniformly and constantly and consequently any formation of cavities between the wire mesh and the concrete is also avoided. Moreover, it is also of advantage that by means of the wiping device 39 in the supply device 35 an automatic wiping off of the concrete material in excess at the top end of the mold and thereby a smoothing of the top end is made possible. Since the upper end of the concrete part 11 is shaped by the axial movement of the molding top ring 34 from above into the molding interspace, a substantially exacter and smoother shape of the end surfaces of the concrete part are achieveable than those produced only through the radial pressure exerted by the radial pressing device 20. Another advantage is that the device 10 in addition to the above-described mode of production of tubular concrete parts, is suitable also for other types of concrete parts such as for example of shaft rings. This versatility results from the vertical shiftability of the entire supply device 35 which for example when manufacturing shaft rings is movable in vertical direction down to the ground level as required for the molding of shaft rings. Also the molding top ring 34 with its separate driving device also contributes to the improved production of shaft rings. In general the device 10 and its control of individual working cycles is simple. The device 10 is readily adaptable for the manufacture of a great assortment of diversified concrete parts 11 of different sizes.

Figure 4:
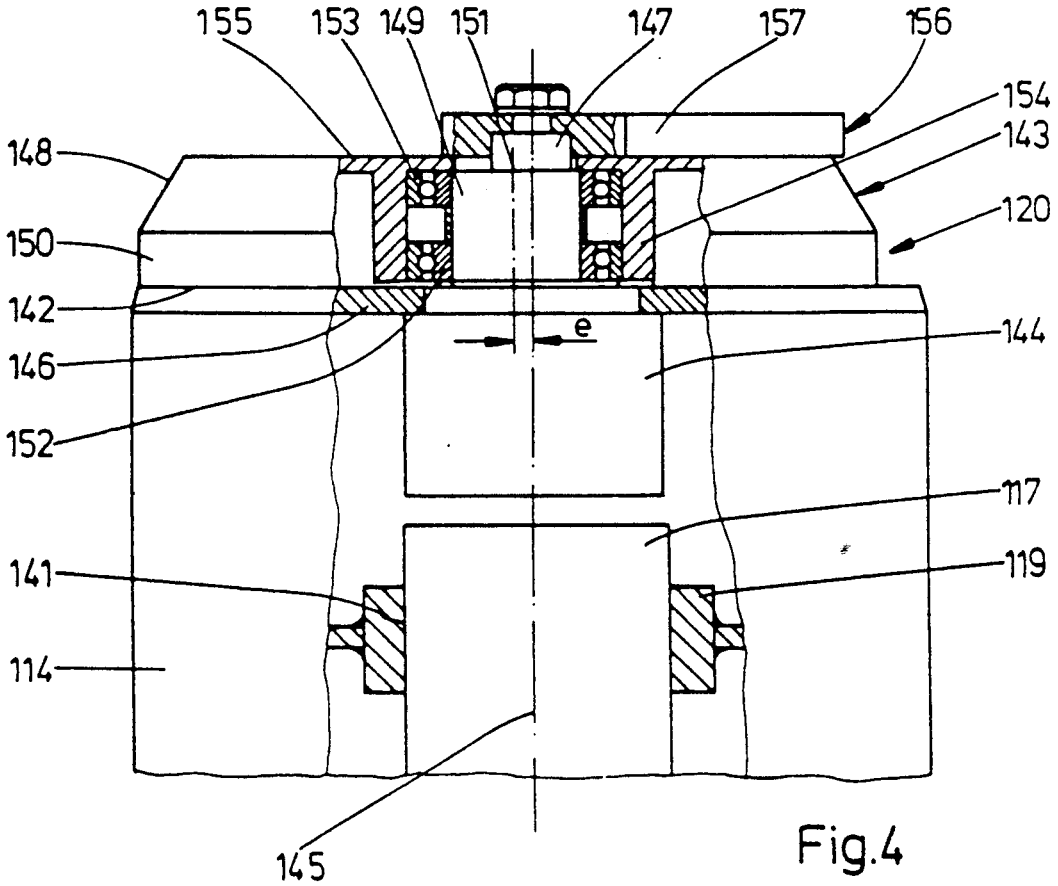
FIG. 4 is a sectional side view, partly in section, of a top part of a mold core provided with a first embodiment of a radial pressing device for concrete material.
Figure 5:
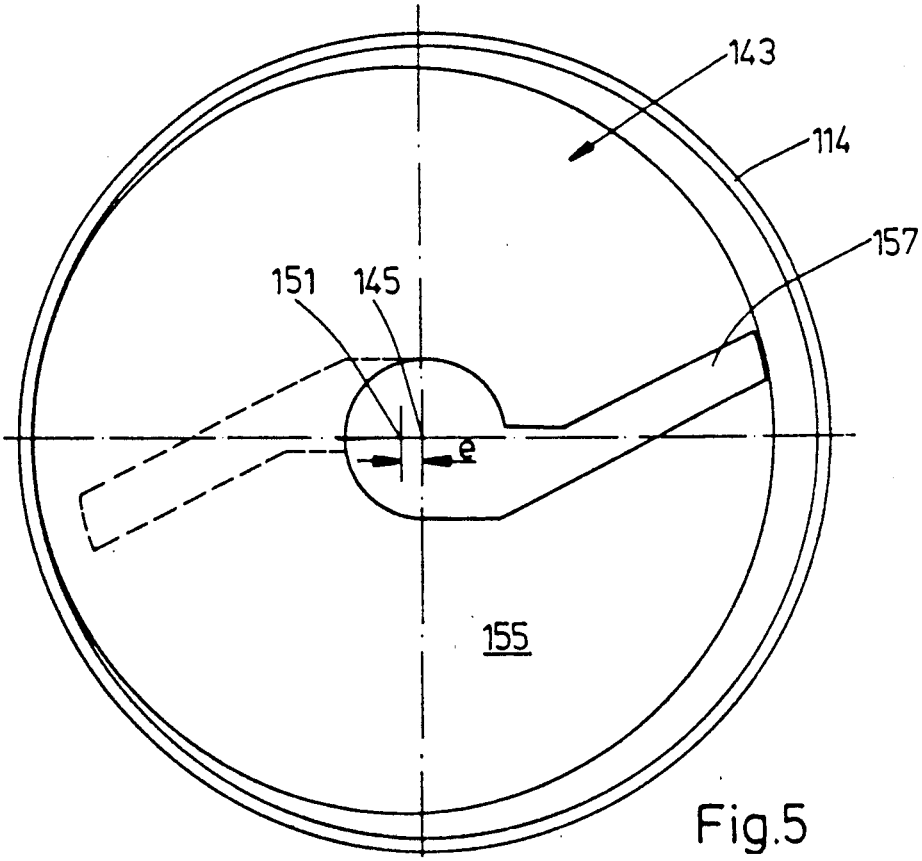
FIG. 5 is a top view of the radial pressing device of FIG. 4.

In the embodiment illustrated in FIGS. 4 and 5, the component parts corresponding to the embodiment of FIGS. 1 to 3 are referred to by the same reference numerals preceded by 1.

In this embodiment the mold core 114 is again mounted on a stationary upright holding fixture 141 by means of a schematically indicated clamping device 119. In this example, the clamping device is a component part of the top outer surface of a central vibrator 117 and is designed such as to releasably clamp and center the inner wall of the mold core 114.

The upper end face of the mold core 114 is provided with a radial pressing device 120. The device 120 includes a pressing head 143 supported for a rotary wobbling movement within the confines of the top end face 142 of the mold core 114 to exert a radial pressure on the incoming concrete material. The pressing head 143 is set into wobbling rotary motion by an eccentric 149 driven by a motor 144 centrally arranged within the mold core 114. The motor 144 is attached to the upper cover plate 146 of the mold core 114 and the eccenter shaft passes through a central opening of the cover plate.

In another non-illustrated embodiment the pressing head 143 is driven by an external drive arranged such that the pressing head 143 is mounted as a separate supplementary element on a smoothing piston or on another mold core and is driven from above by a driving shaft.

The vibrator 117 is driven preferably in counter direction to the direction of rotation of the driving motor 144. The driving motor 144 has a drive shaft 147 which is coaxial with the longitudinal center axis 145 of the mold core 114. The eccenter 148 for driving the pressing head 143 is formed on the coaxial drive shaft 147 and its center axis 151 is offset by a distance e relative to the center axis 145 of the mold core 114. The eccentric 149 supports by means of ball bearings 152, 153 a ring-shaped body 150 of the pressing head 143 for free rotation about the center axis 151 of the eccentric. The free rotation of the ring-shaped body 150 is not necessary but is advantageous in that it introduces no torque in the concrete material during its compression. The bearings 152, 153 engage the inner wall of central bearing box 154 which is firmly connected to the top disc 155 of the ring shaped body 150. The top disc 155 thus represents a cover of the pressing head 143. In a modification, the top cover disc can be provided with radial spokes extending between the ring shaped body 150 and the bearing box 154. The distance between the top disc 155 of the pressing device above the upper surface of the cover plate 146 of the mold core 114 is determined by the height of the bearing box 154. A ring-shaped body 150 together with the top disc 155 has the configuration of a reversed cup. The lower annular side of the ring shaped body 150 slidably engages the top surface of the cover plate 146 of the mold core 114 and is set into a wobbling rotary motion in the radial plane 142 of the upper surface by the driving motor 144.

The radial pressing device 120 further includes a distributing device 156 arranged above the top disc 155 of the pressing head 143. In this embodiment, the distributing device is formed by at least one distributing arm 157 which slidably engages the upper surface of the top disc 155. One end of the distributing arm 157 is firmly connected to the free end of the drive shaft 147 of the motor 144 to continuously rotate about the center axis 145 of the mold core 114. As indicated in dashed lines in FIG. 5, the distributing arm 157 can be offset relative to the rim of the top disc 155 of the pressing head 143.

In another non-illustrated embodiment, the eccentric 149 projects through the center opening of the top disc 155 and the distributing arm 157 is secured to the projecting end of the eccenter shaft.

When the driving motor 154 is switched on, the eccenter shaft 159 imparts to the radial free wheeling pressing head 143 a continuous pressing movement in radial direction. Due to the bearings 152, 153 a relative rotation between the eccenter shaft and the pressing head 143 is made possible whereby the pressing head 143 need not rotate during its radial movement. If this condition is not desired, then a rigid connected between the eccentric 149 and the pressing head 143 is provided. In the illustrated embodiment the driving motor 144 directly rotates in one or the opposite direction the distributing arm 157 only which displaces the concrete material discharged from above in radial direction outwardly into the molding interspace where the concrete is continuously compressed by the radially oscillating ring shaped body 150. Due to the idling rotation of the pressing head 143, no torque is imparted to the concrete and consequently any angular displacement of the reinforcing wire mesh 12 (FIG. 1) is reliably prevented.

In the illustrated embodiment, the central vibrator 117 through which the mold core 114 is set into a vibratory movement whereby a further compression is imparted to the concrete material in the molding space.

In still another non-illustrated embodiment, the central vibrator 117 is dispensed with. In this case, the mold core 114 is releasably clamped by the clamping device 119 to a holding fixture 141 and the compacting or compression of the concrete material is performed exclusively by the pressing head 143. Since in this case only a radial compressing movement takes place no torque is introduced into the concrete. As a consequence, the pressing head is subject only to a minute wear and requires a reduces driving power so that the driving motor 144 can be smaller and of lower power input. Accordingly, the operational and construction costs are reduced. The design of the pressing head 143 inclusive of the bearings is inexpensive. It is also of advantage that the pressing head 143 can be mounted on the top end face of the mold core 114 of if desired can be applied as a separate element on another part, for example on a radial press where it is driven from above by a driving shaft.

In a second embodiment of the pressing head 243 the ring shaped body 250 is secured to the top disc 255 at a distance above the cover plate 246 of the mold core 214 so that the bottom side of the ring shaped body 250 does not contact the cover plate 246. In this manner the movement of the pressing head is facilitated and the wear is reduced. The space between the cover plate 246 and the top plate 255 is sealed off by a circumferential sealing socket 260 of a resilient material. The sealing socket has an approximately C-shaped cross-section whereby its lower side engages the top cover plate 246 and is firmly attached thereto by means of a fastening ring 263 whose groove 264 engages an annular bulge 265 in the sealing socket. In a similar fashion, the upper side 266 of the sealing socket sealingly engages an annular groove in the ring shaped body 250. The ring shaped body is releasably fastened top the top ring 255. The sealing socket 260 is made preferably of rubber, synthetic rubber, resilient plastic material and the like which have a high degree of wear resistance when contacted with the concrete. For example, a commercially available wear resistance sealing material has the trademark "VULKOLLAN".

Similarly as in the example of FIG. 4, the pressing head 243 is driven by the driving motor 244 via an eccentric 249 whose center axis 251 is offset relative to the center axis 245 of the mold core. In this embodiment, the distributing arm 257 is firmly connected to a protruding part 267 of the drive shaft which is coaxial with the axis 251 of the eccentric and therefore is offset with respect to the longitudinal center axis 245.

In this embodiment the provision of the elastic sealing socket 260 ensures a complete seal-off of rotary parts arranged in the inner space 262 of the pressing head 243 from the molding space. Since the ring shaped body 250 does not sit directly on the top cover plate 246 its motion is facilitated and frictional losses and wear are reduced. Consequently, the power requirements of the driving motor are further reduced and so is the overall wear.

Figure 6:
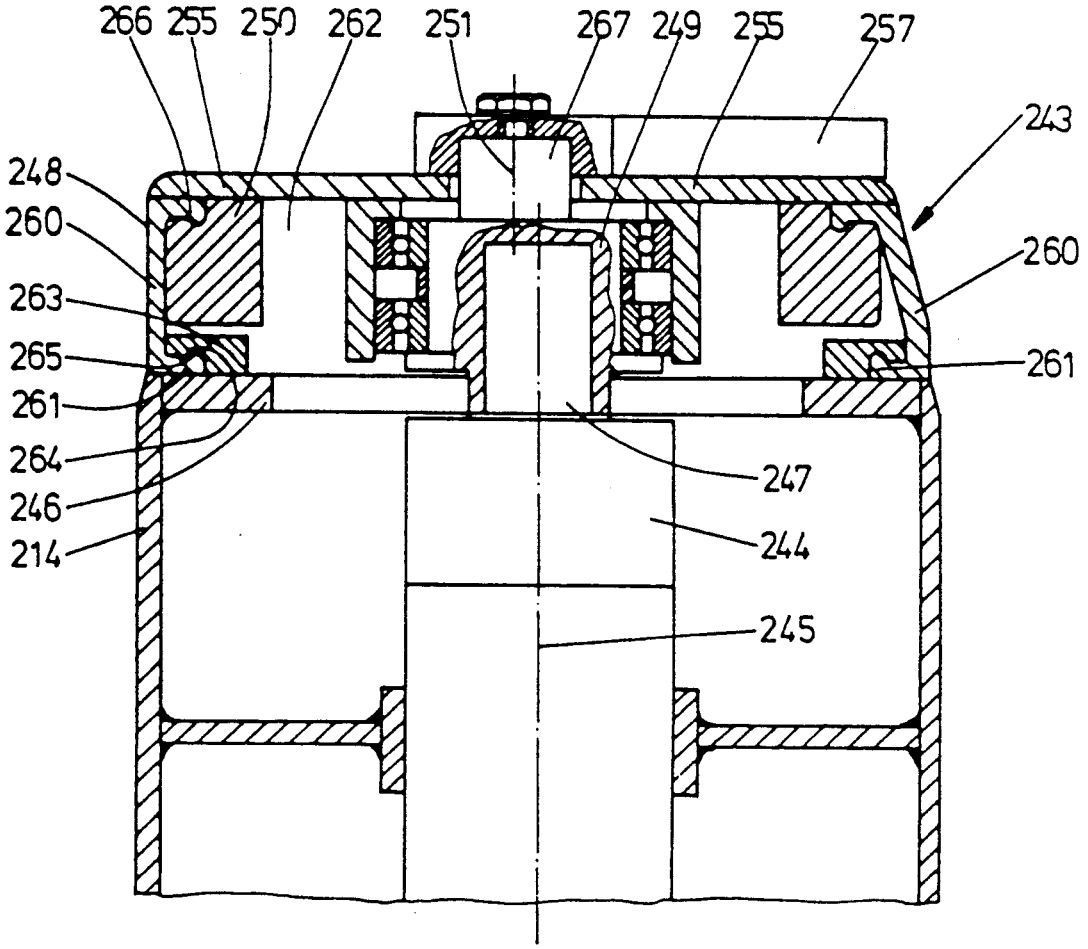
FIG. 6 shows a sectional side view of a second embodiment of a pressing device for concrete material.
Figure 7:
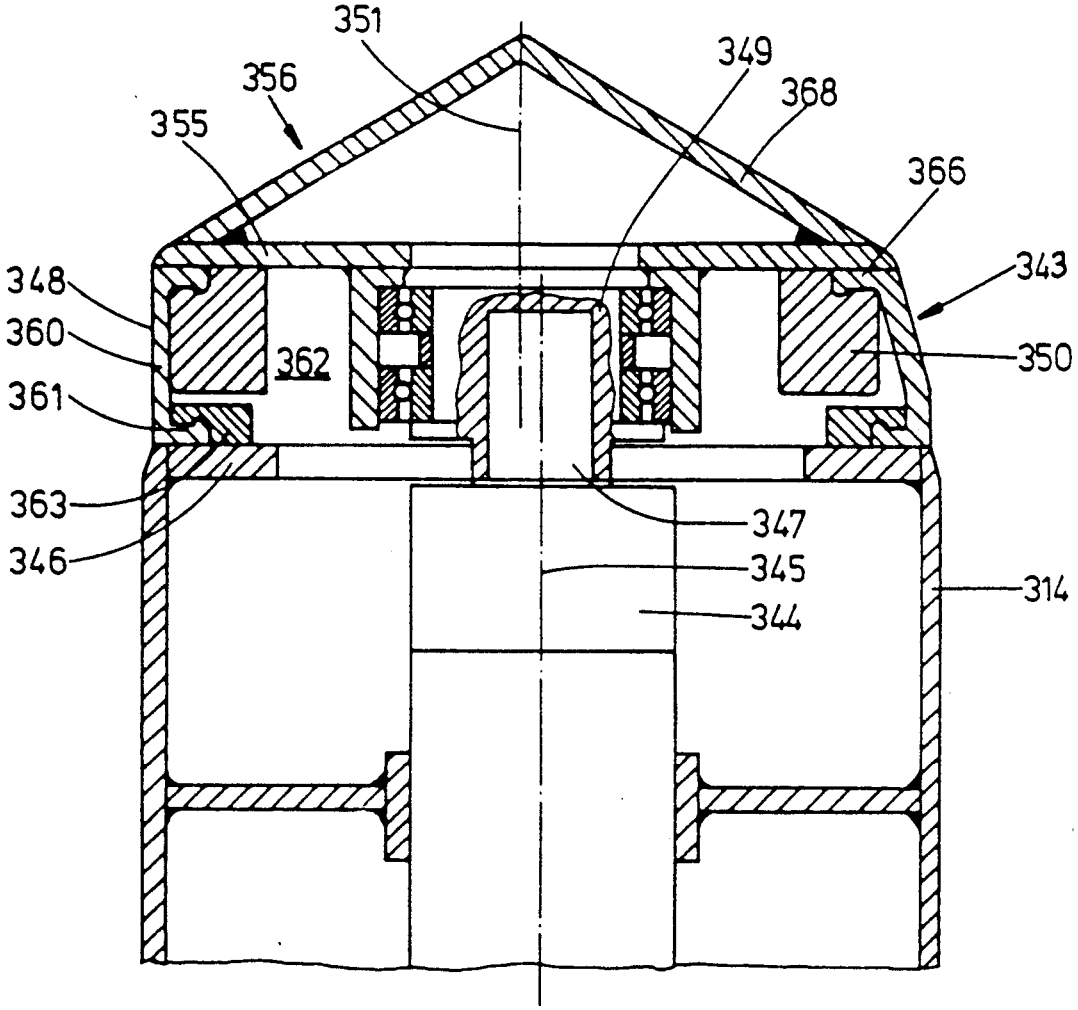
FIG. 7 is a sectional side view of a third embodiment of the pressing device for concrete material.

The third embodiment of the pressing head 343 illustrated in FIG. 7 differs from that of FIG. 6 only by a different arrangement of the distributing device. Instead of the rotating distributing arm, there is provided a cone shaped lid 368 covering the top disc 355 of the pressing head 343. The center axis of the conical lid 368 coincides with the eccenter axis 351. In this manner, the sloping surfaces of the lid 368 act as distributing device 356 which provides a uniform distribution of the incoming concrete material into the molding space. This embodiment is particularly advantageous for the production of concrete parts having a small nominal width.

Figure 8:
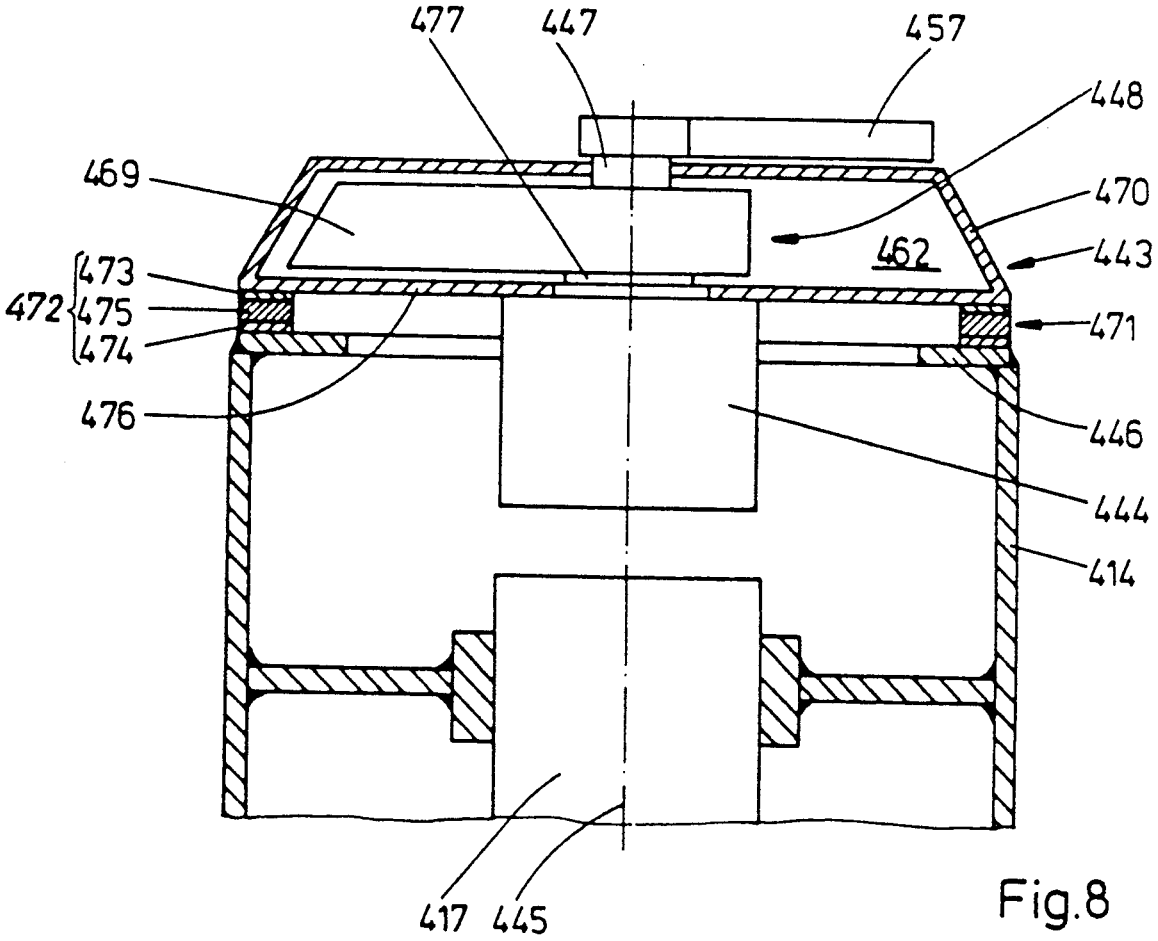
FIG. 8 is a sectional side view of a fourth embodiment of the pressing device of this invention.

In a fourth embodiment of the pressing head 443 in FIG. 8 the eccentric 448 is formed by an eccentric unbalance arm 469 which is at one end firmly connected to the drive shaft 447 of driving motor 444. The unbalance arm thus forms a heavy duty eccentric. Pressing head 443 has a closed housing 470 enclosing the rotating unbalance arm 469. The housing 470 is supported on the top cover plate 446 of the mold core by means of an elastic supporting device 471 which includes at least one silent block 472 whose construction is similar to conventional vibration dampers. For example the silent block includes an annular rubber layer 475 sandwiched between an upper ring 473 and a lower ring 474. The unbalance arm 469 is supported for rotation in an axial bearing 477 arranged in the lower base 476 of the housing around the driving shaft 447. Similarly as in the embodiment of FIG. 4, a distributing arm 457 is attached to the drive shaft 447 above the end face of the housing 470. Also in this embodiment the driving direction of the vibrator 417 is preferably opposite to the direction of rotation of the unbalance arm 469 to counteract the possibility of turning the reinforcing wire mesh. The unbalance arm 469 is driven by the driving motor 444 at a relatively low speed at which the distributing arm 457 is also rotated. After switching on the driving motor 444 and the vibrator 417, the concrete material is distributed by the arm 457 from the top of the housing into the molding space. By the action of the vibrator the mold core 414 vibrates at a relative high frequency and at small amplitudes for examples between 1 to 4 mm. The pressing head 443 on the other hand, oscillates at a low frequency, for example in the order of 100 to 800 oscillations per minutes and at higher amplitudes for example between 10 to 15 mm. The two different amplitude ranges are made possible by the rubber block 472 between the mold core 414 and the pressing head 443 which keeps the mutual influencing of the two frequencies at minimum. Due to the low rotary speed of the drive of the unbalance arm 469 the distributing arm 457 can be directly connected to this drive to rotate at the same speed. The elastic support device 471 has the additional advantage in the provision of excellent seal between the pressing head 443 and the top side of the mold core 414. The driving motor 444 is fastened to the base plate 476 of the housing.

Figure 9:
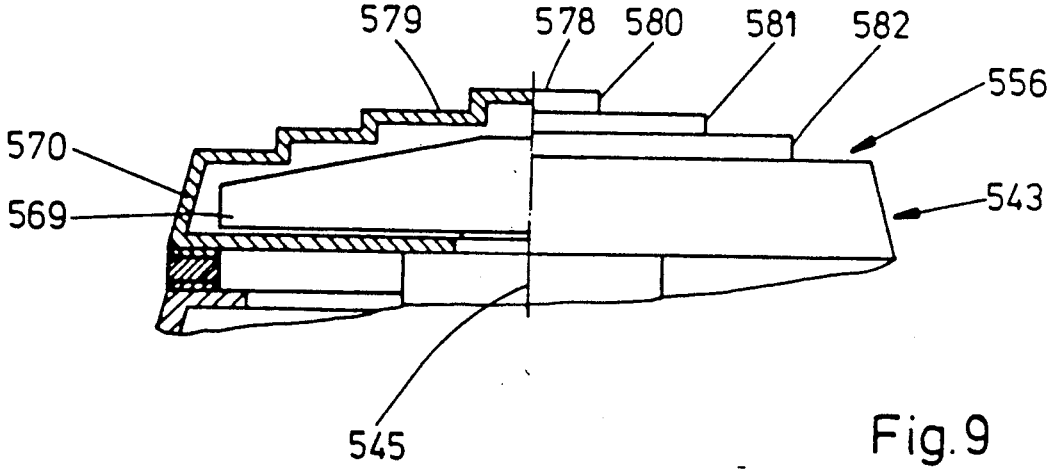
FIG. 9 is a schematic side view, partly in section, of the upper end of a mold core provided with a fifth embodiment of the pressing device for concrete material.

The sixth embodiment of the distributing device 556 illustrated in FIG. 9 distinguishes from the embodiment of FIG. 8 in that the housing 570 performs both distributing and compressing functions. The jacket 578 of the housing 570 is formed as a stepped cone having annular steps 580, 581 and 582 whose widths decreases from top to the bottom. Due to the strong oscillatory movement of the pressing head 543 and thus of the steps 580 to 582 on the housing 570, the concrete material is conveyed outwardly in the direction of the molding space. In the manner any wear which might occur in the distributing arm 457 in FIG. 8 is avoided.

Figure 10:
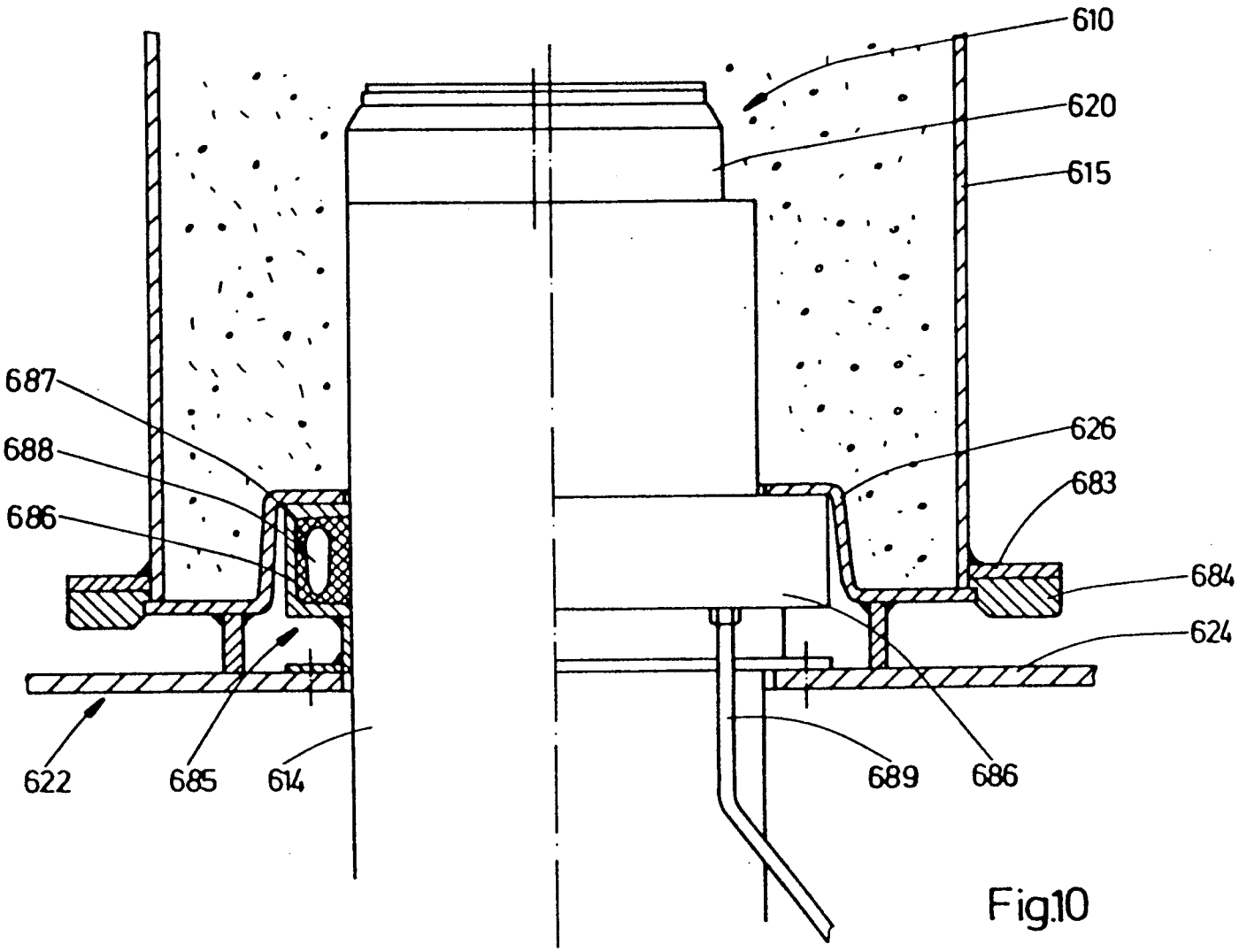
FIG. 10 shows in a sectional side view a modification of a detail in the manufacturing device of FIG. 1.

FIG. 10 illustrates a modification of the device 610 of this invention which in principle corresponds to the device 10 in FIGS. 1 to 3. The difference resides in the provision of a mold jacket 615 which is cylindrical also at its bottom end and is provided at its lower edge with locking means in the form of a flange or ring 683 welded to the mold jacket in proximity to its bottom edge. Another centering ring 684 is screwed on the outer rim of the molding bottom ring 626 and abuts against the lower side of the welded ring 683. In addition, between the mold core 614 and the bottom ring 626 is arranged an adjustable sealing device 685 which is firmly connected to the mold ejector 622. The sealing device 685 consists of a retaining ring 686 of an approximately S-shaped cross-section whose lower side is secured to the ejector plate 624 of the mold ejector and whose upper half serves for receiving a flexible hollow body 687 for example in the form of a rubber hose. The outer sides of the rubber hose 687 engage the inner walls of the upper part of the retaining ring 686 whereas the free inner side engages the outer surface portion of the mold core 614. The interior 688 of the rubber hose 687 is connected via a feeding conduit 689 to a source of pressure medium. If it is desired to activate the sealing device 685 then pressure medium is introduced into the inner space 688 of the hose to inflate the same at a pressure which is adjustable at will. In this manner the seal between the molding space and the mold core is readily adjustable so that even after the hollow elastic body or rubber hose 687 has been subject to a wear a constant compressing force of the hose against the mold core can be achieved. Normally the sealing device 685 is activated only during the filling and compressing steps when the rubber hose 687 is sealingly pressed against the outer surface portion of the mold core 614. During the removal of the mold jacket the rubber hose 687 is pressure released and the friction between the sealing body 687 and the mold core 614 is minimized and the core can be easily withdrawn. With activated sealing device 685 any leakage of concrete mixture between the mold core and the bottom ring is effectively prevented.

Figure 11:
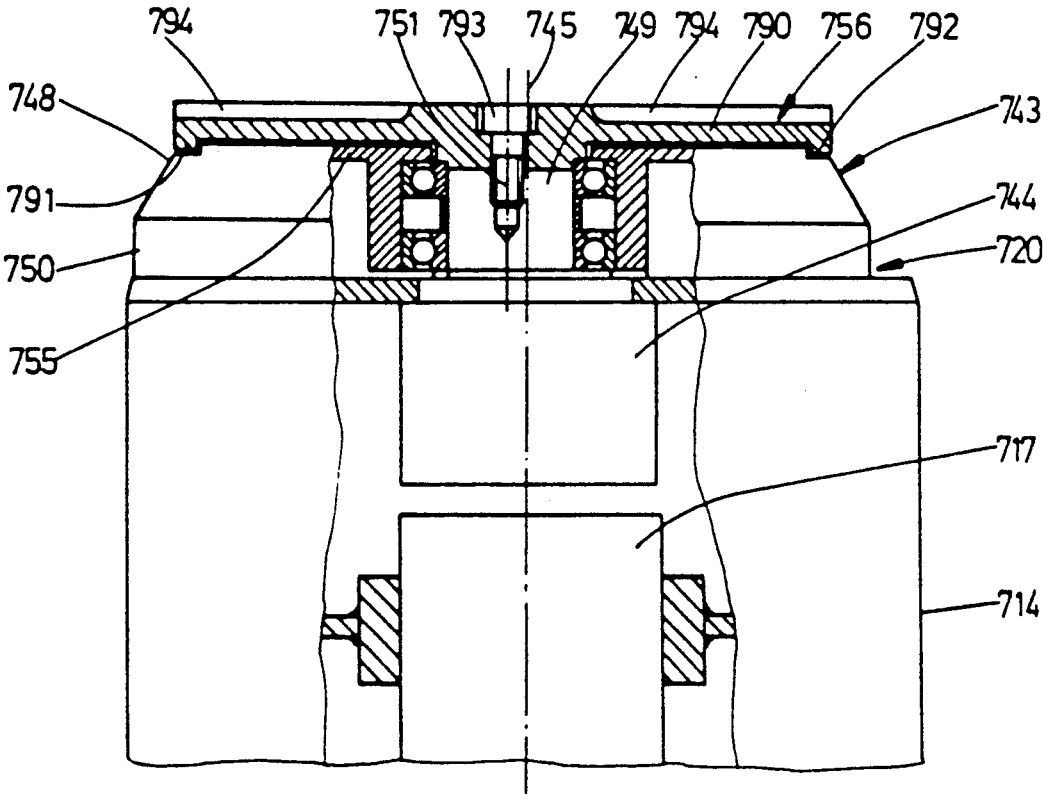
FIG. 11 shows a schematic sectional side view of a sixth embodiment of the pressing device.
Figure 12:
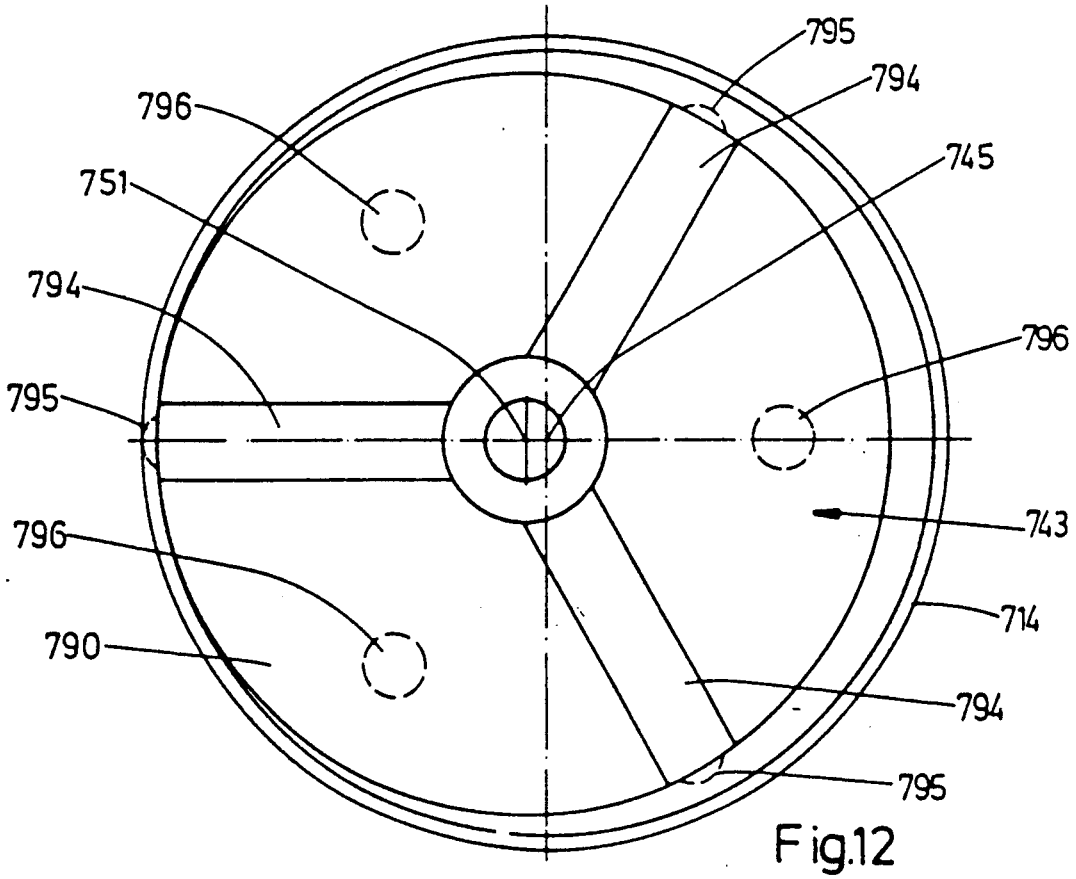
FIG. 12 is a top view of the device of FIG. 11.

The sixth embodiment of the distributing device 756 shown in FIGS. 11 and 12 is similar to that of FIGS. 4 and 5 with the exception that instead of a distributing arm there is provided a distributing disc 790 secured to the eccentric shaft or eccentric 749 whereby the center axis of the disc 790 coincides with the center axis 751 of the eccentric. The distributing disc 790 rotates a minute distance above the top surface of the cover plate 755 of the ring shaped body 750 of the compression head so that the distributor disc substantially covers the top surface of the disc 755. In a non-illustrated modification the distributing disc 790 is larger in diameter than the top disc or alternatively the diameter of the distributing disc is smaller than that of the top disc 755.

In the illustrated embodiment, there is a minute clearance between the bottom side of the distributing disc and the top side of the cover disc of the pressing head. The circumference of the distributing disc is provided with an outwardly directed flange 791 which slidably engages a corresponding annular groove 792 in the upper side of the pressing head 743. In this manner, a labyrinth-like seal is created which prevents the entry of concrete mixture between the ring shaped body 750 and the distributing disc 790. The distributing disc 790 is secured to the eccenter shaft eccentric 749 by a center screw 793 and as mentioned before rotates concentrically with the free rotary movement of the ring shaped body of the pressing head. In this embodiment the distributing disc 790 is provided on its upper side with equidistant, radially directed strips 794 integrally connected to the distributing disc. The radial strips extend up to the circumferential edge of the distributing disc 790. As indicated by dashed lines in FIG. 12, the outer ends of the distributing radial strips 794 are provided with radially projecting rounded projections 795. Additional convex projections 796 are provided on the upper surface of the distributing disc between the radial strips. In another, non-illustrated modification the upper surface and/or the circumferential side of the distributing disc 790 is provided with differently shaped projections such as webs, strips, cams and the like or recesses such as grooves, pits and the like.

This embodiment of the distributing device 756 has the advantage of an extremely low susceptibility to wear because any entry of concrete mixture between the ring shaped body 750 and the distributing device 756 is completely eliminated. During the charging, the concrete material falls on distributing disc 790 and is rotated thereon. Due to this rotary movement a centrifugal acceleration of the concrete is created which swings the concrete outwardly to the molding space. By radial strips 794 or projections 795 and 796 the acceleration of the concrete is still increased. If the mold is overcharged, for example too much concrete mixture is present on the distributing disc 790, the torque increases accordingly. In the preferred embodiment the torque is measured and employed for the regulation of the operation, for example of the feeding rate of the supply device 35 (FIG. 1). In this manner the distributing device 756 provides a sensor for the overload regulation.

While the invention has been illustrated and described as embodied in specific examples of the manufacturing device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for manufacturing concrete parts in a mold comprising an upright vibrator for producing rotary vibrations; said vibrator being secured at one end thereof to a stationary support; a tubular mold core releasably mounted on said vibrator, said mold core defining a longitudinal center axis which coincides with a center axis of said vibrator and having a top end face which extends in a radial plane intersecting at right angles said longitudinal center axis; a mold jacket movable in two opposite vertical directions relative to said mold core to define a variable molding space therewith; an eccentric supported on said top end face of the mold core and projecting into said radial plane; said eccentric defining a center axis which is offset relative to said longitudinal center axis of the mold core; a driving motor having a drive shaft for rotating said eccentric; a ring-shaped pressing head supported for rotation about said eccentric and being driven by said eccentric such as to perform an oscillatory rotary movement within said radial plane and to exert a radial pressure on concrete material in the molding space; said pressing head having a top surface provided with a distributing device for directing the concrete material into the molding space; and said rotary vibrations of the vibrator being opposite to the direction of rotation of said pressing head.

2. A device as defined in claim 1, wherein said driving motor for the pressing head is arranged within said mold core and a center axis of the drive shaft being coaxial with the longitudinal center axis of the mold core.

3. A device as defined in claim 1, wherein said driving motor for the pressing head is arranged outside said mold core.

4. A device as defined in claim 1, wherein said eccentric is firmly connected to a drive shaft of said driving motor.

5. A device as defined in claim 1, wherein said distributing device includes at least one distributing arm connected to the drive shaft of said driving motor and engaging the top surface of said pressing head to sweep the concrete material outwardly into the molding space.

6. A device as defined in claim 5, wherein said distributing arm is offset relative to said center axis of the pressing head and is inclined in the direction of rotation of the driving motor.

7. A device as defined in claim 1, wherein said distributing device includes a distributing arm connected to the eccentric on said drive shaft.

8. A device as defined in claim 1, wherein said distributing device is a conical lid secured to the top surface of said pressing head and a center axis of said lid being offset relative to the longitudinal center axis of said mold core.

9. A device as defined in claim 1, wherein said distributing device includes a distributor disc eccentrically connected to the drive shaft of said driving motor to rotate over the entire top surface of said pressing head.

10. A device as defined in claim 9, wherein said distributor disc is provided with a downwardly directed peripheral flange slidably engaging a peripheral recess formed in the top surface of said pressing head to form a labyrinth like seal therein.

11. A device as defined in claim 9, wherein the upper surface of said distributor disc is provided with distributing projections.

12. A device as defined in claim 11, wherein said distributing projections comprise a plurality of uniformly spaced and radially directed distributing strips.

13. A device as defined in claim 9, wherein a diameter of the distributor disc differs from a diameter of the top surface of the pressing head.

14. A device as defined in claim 1, wherein said ring shaped pressing head is supported for free rotation about said eccentric.

15. A device as defined in claim 14, wherein said ring shaped pressing head is covered by a top disc having a center region provided with a downwardly directed bearing box surrounding said eccentric and enclosing at least one bearing mounted on said eccentric.

16. A device as defined in claim 15, wherein said bearing box and said bearing rotate above the top end face of said mold core.

17. A device as defined in claim 15, wherein said bearing box is connected to said ring shaped pressing head by radial spokes.

18. A device as defined in claim 14, wherein said ring shaped pressing head has a frustoconical upper portion.

19. A device as defined in claim 18, wherein a lower annular end face of said ring shaped pressing head slidably engages the top end face of said mold core.

20. A device as defined in claim 15, wherein said ring shaped pressing head is connected to said top disc at a distance from the top end face of said mold core.

21. A device as defined in claim 20, further comprising a sealing sleeve of resilient, wear resistant material, said sealing sleeve having a lower end connected to the top end face of said mold core and an upper end which slidably engages a groove between said ring shaped pressing head and the top disc of said pressing head to seal off the bearing box of said pressing head from the molding space.

22. A device as defined in claim 21, wherein the wear resistant material is selected from the group consisting of natural rubber, synthetic rubber and a resilient plastic material.

23. A device as defined in claim 1, wherein said eccentric is a radially directed unbalanced arm secured at one end thereof to the drive shaft of said driving motor.

24. A device as defined in claim 23, wherein the pressing head includes a stationary housing of a frustoconical configuration resiliently supported on the top end face of said mold core by an elastic block including a rubber layer, said driving motor being secured to a bottom side of said housing and said unbalanced arm rotating within said housing.

25. A device as defined in claim 24, wherein said frustoconical housing has a stepped configuration including concentric annular steps.

26. A device as defined in claim 24, wherein the drive shaft of said driving motor projects above a top side of said frustoconical housing and is connected to a distributing arm.

27. A device as claimed in claim 25, wherein the width of the annular steps decreases from a top side to bottom side of said housing.

* * * * *